US008507415B2

(12) United States Patent
Waynick

(10) Patent No.: US 8,507,415 B2
(45) Date of Patent: Aug. 13, 2013

(54) LUBRICANT OILS AND GREASES CONTAINING NANOPARTICLE ADDITIVES

(75) Inventor: John A. Waynick, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 958 days.

(21) Appl. No.: 11/417,276

(22) Filed: May 3, 2006

(65) Prior Publication Data

US 2007/0004602 A1 Jan. 4, 2007

Related U.S. Application Data

(60) Provisional application No. 60/677,071, filed on May 3, 2005.

(51) Int. Cl.
*C10M 159/12* (2006.01)

(52) U.S. Cl.
USPC ..... 508/154; 508/162; 508/174; 508/175; 508/180; 508/460

(58) Field of Classification Search
USPC ..... 508/390–392, 421, 433, 445, 459–462, 508/154, 162, 174, 175, 180
See application file for complete search history.

(56) References Cited

U.S. PATENT DOCUMENTS

| | | | | |
|---|---|---|---|---|
| 4,137,187 | A | 1/1979 | Lowe | |
| 4,159,252 | A | 6/1979 | Wainwright et al. | 252/25 |
| 4,164,472 | A | 8/1979 | Cheng et al. | |
| 4,328,111 | A | 5/1982 | Watson et al. | |
| RE31,611 | E | 6/1984 | Wainwright et al. | 252/25 |
| 4,493,776 | A | 1/1985 | Rhodes | |
| 4,543,195 | A | 9/1985 | Grangette et al. | 252/33.4 |
| 4,830,767 | A | 5/1989 | Waynick | 252/25 |
| 4,986,923 | A | 1/1991 | Waynick | 252/25 |
| 5,102,565 | A | 4/1992 | Waynick | 252/18 |
| 5,147,571 | A | 9/1992 | DeRosa et al. | |
| 5,158,694 | A | 10/1992 | Waynick | 252/18 |
| 5,207,935 | A * | 5/1993 | Waynick | 508/158 |
| 5,223,161 | A * | 6/1993 | Waynick | 508/177 |
| 5,232,614 | A | 8/1993 | Colclough et al. | 252/32.7 E |
| 5,320,765 | A | 6/1994 | Fetterman, Jr. et al. | |
| 5,401,424 | A | 3/1995 | Vinci et al. | 252/18 |
| 5,460,737 | A | 10/1995 | Sakai et al. | |
| 5,464,548 | A | 11/1995 | Cahoon et al. | 252/18 |
| 5,523,006 | A | 6/1996 | Strumban | |
| 5,652,201 | A | 7/1997 | Papay et al. | |
| 5,712,230 | A | 1/1998 | Abraham et al. | |
| 5,877,130 | A | 3/1999 | Kohara et al. | |
| 6,046,144 | A | 4/2000 | Karol et al. | |
| 6,140,279 | A | 10/2000 | Emert et al. | |
| 6,310,011 | B1 | 10/2001 | Karn et al. | |
| 6,531,428 | B2 | 3/2003 | Nakazato et al. | |
| 6,599,867 | B2 | 7/2003 | Hammond et al. | |
| 7,419,941 | B2 * | 9/2008 | Waynick | 508/262 |
| 2002/0142922 | A1 | 10/2002 | Yagishita et al. | |
| 2003/0134756 | A1 | 7/2003 | Carrick et al. | |
| 2003/0139302 | A1 | 7/2003 | Akada et al. | |
| 2003/0166474 | A1 | 9/2003 | Winemiller et al. | |
| 2004/0048753 | A1 | 3/2004 | Ritchie et al. | |
| 2004/0235678 | A1 | 11/2004 | Di Biase et al. | |
| 2004/0235684 | A1 | 11/2004 | Cook et al. | |
| 2004/0235688 | A1 | 11/2004 | Locke et al. | |
| 2005/0137098 | A1 | 6/2005 | Le Coente et al. | |
| 2005/0269548 | A1 | 12/2005 | Jeffcoate et al. | |

FOREIGN PATENT DOCUMENTS

| | | |
|---|---|---|
| WO | 01/27226 | 4/2001 |
| WO | 2006119502 A3 | 11/2006 |

OTHER PUBLICATIONS

International Search Report and Written Opinion dated Aug. 8, 2007 issued in related International Application No. PCT/US06/17101 (6 pages).
International Search Report and written Opinion dated Aug. 29, 2007 issued in related International Application No. PCT/US0617564 (9 pages).
U.S. Office Action dated Jul. 17, 2009 issued in related U.S. Appl. No. 11/417,001.
U.S. Office Action dated Apr. 14, 2010 issued in related U.S. Appl. No. 11/417,001.
International Search Report dated Aug. 8, 2007 issued in related International Patent Application No. PCT/US06/17101.
Bearchell, et al., Phys. Chem. Chem. Phys. (PCCP), 2000, 2, pp. 5197-5207; "Experimental and Molecular Modelling Studies of Overbased Detergent Particles."
Final Office Action dated Sep. 22, 2010 issued in related U.S. Appl. No. 11/417,001.
US Office Action dated Sep. 8, 2011 issued in related U.S. Appl. No. 11/417,001.
US Office Action dated Apr. 12, 2012 issued in related U.S. Appl. No. 11/417,001.

* cited by examiner

*Primary Examiner* — Taiwo Oladapo
(74) *Attorney, Agent, or Firm* — Grossman, Tucker et al

(57) ABSTRACT

Lubricant oil and grease composition containing an additive package comprising wear-resistant additives in the form of nanoparticles, wherein the additives are a carbonate selected from the group consisting of a carbonate of a Group 1a alkali metal and a carbonate of a Group 2a alkaline earth metal, a sulfate of a Group 1a alkali metal or a Group 2a alkaline earth metal, a phosphate of a Group 1a alkali metal or Group 2a alkaline earth metal, a carboxylate of a Group 1a alkali metal and a carbonate of a Group 2a alkaline earth metal, or a combination thereof.

5 Claims, No Drawings

LUBRICANT OILS AND GREASES CONTAINING NANOPARTICLE ADDITIVES

This application claims priority to U.S. provisional application Ser. No. 60/677,071, filed May 3, 2005, incorporated herein in its entirety.

BACKGROUND OF THE INVENTION

This invention pertains to lubricants and greases containing mixed bases, including bases composed of nanoparticles or phenates/sulfonates containing mixed bases or both, wherein the mixed base is composed of, for example, carbonate such as calcium carbonate, a carboxylate such as calcium carboxylate, a phosphate such as tricalcium phosphate, and/or calcium sulfate.

Lubricant oils and greases are commonly used for a variety of applications. For example, lubricant oils are used as crankcase lubricants for internal combustion engines, including gasoline and diesel engines. With the current and anticipated emission regulations, automotive manufactures have been conducting research to develop exhaust aftertreatment devices and other mechanical features to meet the new lower emissions standards. Engine oil is affected by these regulations in that it will need to have significantly lower levels of phosphorous in order to avoid the harmful effects over time on the new exhaust aftertreatment devices. This is a problem for the engine oil formulator because for decades zinc dithiophosphates have been the primary anti-wear additive used for engine oils. Reducing the level of phosphorous in engine oil requires a similar reduction in zinc thiophosphates or other phosphorous-containing anti-wear additives. The inventor has identified that a need exists to provide a solution to this problem.

In addition, various additives can be added to lubricating oils in order to improve various oil properties. Anti-wear agents are intended to decrease wear of machine parts. Additives have been and continue to be developed for use in such oil compositions to improve the lubricating characteristics thereof and thereby to lessen the wear of the moving parts.

Lubricating oils tend to deteriorate under the conditions of use in present day automotive engines, with attendant formations of sludge and lacquer and resinous materials which adhere to the engine parts, thereby lowering the operating efficiency of the engine. Detergents and dispersants are added to the lubricating oil to keep the deposit forming materials suspended in oil so that the engine is kept clean and in efficient operation condition for extended periods of time.

Some common additives used in lubricating oils are metal sulfonates and phenates. In many cases, these additives are overbased, that is, contain a molar excess of base over that needed to neutralize the sulfonic acid or phenolic material. Overbased metal sulfonates are commonly used in lubricating oil compositions as rust inhibitors and detergents. Overbased phenates, including sulfurized phenates, are commonly used in lubricating oil compositions as detergents and antioxidants.

SUMMARY OF THE INVENTION

This invention is, generally, mixed bases, including bases composed of nanoparticles or phenates/sulfonates containing mixed bases or both, wherein the mixed base is composed of, for example, carbonate such as calcium carbonate, a carboxylate such as calcium carboxylate, a phosphate such as tricalcium phosphate, and/or calcium sulfate. The mixed bases can be added to lubricating oils or greases to provide anti-wear properties to the oil or grease. The mixed bases, either in the form of nanoparticles or as mixed bases in overbased phenate and/or sulfonate compositions or both, provide unexpectedly superior anti-wear properties when added to, for example, lubricant oils and greases.

In one respect, this invention is an improved adherent, friction-reducing lubricant oil or grease composition is provided which contains nanoparticles of a carbonate, a carboxylate such as calcium acetate, a phosphate, a sulfate, or a combination of two or more of these materials. As used herein, "nanoparticles" refers to particles having a mean diameter generally less than 1,000 nanometers, more typically less than 100 nanometers, and in one embodiment in the range from 1 to 100 nanometers. In one embodiment, the invention is a lubricant having a low viscosity such as is used as engine oil for gasoline or diesel engines used in automobiles and trucks. Fluid lubricants typically are Newtonian or near-Newtonian whereas greases are non-Newtonian. A Newtonian fluid is one in which the absolute viscosity is independent of the shear rate. A non-Newtonian material is one which the absolute is dependent of the shear rate. In general, the Newtonian lubricant lacks a thickener. By contrast, in another embodiment of this invention, the greases of this invention include a base oil and a thickener.

It is believed that the lubricant and grease of this invention that contain nanoparticles provide good friction reduction and provides excellent adherence to the surfaces to be treated, the exact amount of which can be controlled by variations in the levels of the components of its novel composition. It is believed that the lubricant and grease of this invention has outstanding extreme pressure and wear resistance properties which are, advantageously, provided without imparting any corrosivity and with limited amounts of phosphorous containing additives commonly used in lube oils today. This invention provides formulations which may contain phosphorous containing additives, but which use such phosphorous materials in amount within regulatory guidelines and which do not deleteriously impact the aftertreatment devices discussed above. For instance, through the practice of this invention it may be possible to use a zinc thiophosphate in an oil formulation in smaller amounts than previously utilized but which amounts falls within acceptable ranges for regulatory guidelines and the aftertreatment devices. Advantageously, the oils of this invention employ additives of a size small enough to be permanently suspended without settling out. Through use of the additives of this invention, phosphorous containing additives used in the prior art can be limited or omitted entirely. In addition, the nanoparticles would preclude any plugging of oil filters. It is possible that use of the additives of this invention, frictional heat generated under low and high loads may be reduced relative to traditional additives. With respect to the greases of this invention, the use of nanoparticles may impart lower noise generation and smoother micro-structure.

In one broad respect, this invention is a lubricant oil which comprises: (a) a substantial proportion of a base oil and (b) a sufficient amount of an additive package to impart antiwear properties to the lubricant, wherein the additive package is in the form of nanoparticles. The additive package may also provide extreme pressure resistant properties to the compositions of this invention. In one embodiment, the additive package comprises the nanoparticles of a carboxylate such as calcium carboxylate, a carbonate such as calcium carbonate, a phosphate such as monocalcium phosphate, dicalcium phosphate, or tricalcium phosphate, and/or a sulfate such as calcium sulfate. In one embodiment, the lubricant does not contain a thickener such as used in the grease of this invention.

In one broad respect, this invention is a grease which comprises: (a) a substantial proportion of a base oil, (b) a thickener, such as polyurea, triurea, biurea, calcium soap thickener (simple or complex), lithium soap thickener (simple or complex), aluminum soap thickener (simple or complex), or combinations thereof, (c) a sufficient amount of an additive package to impart antiwear properties to the grease, wherein the additive package is in the form of nanoparticles. In one embodiment, the additive package comprises the nanoparticles of a carboxylate such as calcium carboxylate, a carbonate such as calcium carbonate, a phosphate such as monocalcium phosphate, dicalcium phosphate, or tricalcium phosphate, and/or a sulfate such as calcium sulfate. The grease may optionally include a polymeric additive that cooperates and is compatible (non-interfering) with the antiwear additive package to provide retentivity, friction reduction, wear reduction, mobility, and pumpability while also maintaining an environmentally safe product.

The lubricant oil and grease of this invention may be optionally augmented with other antiwear additives such as graphite and molybdenum disulfide, as well as other additives commonly employed in lubricants and greases. Alternatively, such other antiwear additives can be omitted. The grease may be further augmented in its composition by a boron-containing material to further inhibit oil separation.

The polymeric additive can comprise: polyesters, polyamides, polyurethanes, polyoxides, polyamines, polyacrylamides, polyvinyl alcohol, ethylene vinyl acetate, or polyvinyl pyrrolidone; polyolefins (polyalkylenes), such as polyethylene, polypropylene, polyisobutylene, ethylene propylene, and ethylene butylene; or polyolefin (polyalkylene) arylenes, such as polymers of ethylene styrene and styrene isoprene; polyarylene polymers such as polystyrene; polyacrylate, or polymethacrylate; or combinations, or boronated analogs (compounds) of the preceding. Preferably, the polymeric additive comprises: polyolefins (polyalkylenes), such as polyethylene, polypropylene, polyisobutylene, ethylene propylene, and ethylene butylene; or polyolefin (polyalkylene) arylenes, such as ethylene styrene and styrene isoprene; polyarylene polymers such as polystyrene. As used in this application, the term "polymer" means a molecule comprising one or more types of monomeric units chemically bonded together to provide a molecule with at least six total monomeric units. The monomeric units incorporated within the polymer may or may not be the same. If more than one type of monomer unit is present in the polymer the resulting molecule may be also referred to as a copolymer.

The use of combinations of carboxylates, carbonates, phosphate, and/or the sulfates may possibly produce good results over the use of these additives alone.

The non-corrosivity of the mixture of calcium sulfate and calcium carbonate at very high temperatures is also in marked contrast to oil-soluble sulfur-containing materials.

In another embodiment, the nanoparticle additive package comprises sulfates and carbonates with a minor amount of hydroxides. The preferred hydroxide is calcium hydroxide. The addition of calcium hydroxide to the sulfate/carbonate mixture imparts improved wear resistance to the oil or grease and also provides additional overbasing to neutralize acidic materials which form over long periods of time as the oil or grease oxidizes.

In another broad respect, the nanoparticles additive packages, oils containing the nanoparticle additives, and greases containing the nanoparticles additives may optionally also include the mixed base overbased phenates and/or sulfonates described herein. The addition of the mixed base overbased phenates and/or sulfonates help disperse the nanoparticles and may facilitate the reduction in the amount of nanoparticles needed for a given application due to the presence of the mixed base in the overbased phenate and/or sulfonate. The addition may also provide a more stable composition.

In another broad respect, the inventor has determined that overbased phenates and sulfonates which contain combinations of base compounds provide, unexpectedly, synergistic anti-wear properties. The base compounds in the overbased phenates and/or sulfonates can be solids, including nanoparticles, but may also be part of a liquid or are part of a an oil-based composition containing an oil-soluble overbased phenates and/or sulfonates anti-wear composition. The oil and grease compositions of this invention may include such overbased sulfonates and/or phenates. It is believed that the lubricant and grease that contain the overbased phenates and/or sulfonates of this invention provides improved anti-wear properties and friction reduction.

In this regard, in another broad respect, a method of manufacturing a lubricant oil composition, comprising: combining and mixing a base oil and an additive package comprising wear-resistant additives in the form of nanoparticles, wherein the additives are a carbonate selected from the group consisting of a carbonate of a Group 1a alkali metal and a carbonate of a Group 2a alkaline earth metal, a sulfate of a Group 1a alkali metal or a Group 2a alkaline earth metal, a phosphate of a Group 1a alkali metal or Group 2a alkaline earth metal, a carboxylate of a Group 1a alkali metal and a carbonate of a Group 2a alkaline earth metal, or a combination thereof.

In another broad respect, this invention is a method of manufacturing a lubricant grease composition, comprising: combining and mixing a base oil, a thickener, and an additive package comprising wear-resistant additives in the form of nanoparticles, wherein the additives comprising a carbonate selected from the group consisting of a carbonate of a Group 1a alkali metal and a carbonate of a Group 2a alkaline earth metal, a phosphate of a Group 1a alkali metal or Group 2a alkaline earth metal, a sulfate of a Group 1a alkali metal or a Group 2a alkaline earth metal, a carboxylate of a Group 1a alkali metal and a carbonate of a Group 2a alkaline earth metal, or a combination thereof.

This invention, in another broad respect, includes methods of lubricating a substrate, comprising applying the oil composition or grease composition of this invention to the substrate. The substrate can be, but is not limited to, metals, alloys, moving parts such as in engines and transmissions, and so on.

The compositions of this invention may be optionally augmented with other anti-wear additives such as graphite and molybdenum disulfide, as well as other additives commonly employed in lubricants and greases. Alternatively, such other anti-wear additives can be omitted. The compositions, particularly the greases, may be further augmented in its composition by a boron-containing material to further inhibit oil separation.

DETAILED DESCRIPTION OF THE INVENTION

The lubricating oil of this invention, in general, comprises the base oil and the additive package of nanoparticles or the mixed base overbased phenates and/or sulfonates additive or both. In general, the base oil is present in an amount of at least about 75% by weight, alternatively at least 80%, and in one embodiment at least 90%, based on the total weight of the lubricant oil composition including all other components. In general, the base oil is present in an amount of less than about 99% by weight, and in one embodiment less than about 95% by weight. In general the nanoparticle additive package or mixed base overbased phenate and/or sulfonate or both is present in an amount up to 10% by weight, in one embodiment up to 8%. In general the additive package is present in an amount of at least 0.1% and in one embodiment at least 1%.

The grease of this invention, in general, comprises by weight: 45% to 90% base oil, 5% to 20% thickener, and 0.5% to 30% nanoparticles antiwear additives or mixed base overbased phenates and/or sulfonates. If present, the amount of the polymer is from 1% to 10% of adhesive polymer. In one embodiment, the lubricating lubricating grease comprises by weight: at least 65% base oil, at least 3% thickener, and 8% to 20% nanoparticles antiwear additives or mixed base overbased phenates and/or sulfonates or both. When the grease is thickened substantially by polyurea, triurea, biurea, calcium soaps (simple or complex), lithium soaps (simple or complex), or aluminum soaps (simple or complex), or combinations thereof, the lubricating grease typically comprises by weight 3% to 14% of said thickener. In one embodiment, the lubricating grease comprises by weight 4% to 8% of said thickener.

Either the nanoparticles additive package or mixed base overbased phenates and/or sulfonates or both may be complemented by the addition of small amounts of an antioxidant and a corrosion inhibiting agent, as well as dyes and pigments to impart a desired color to the composition. Antioxidants or oxidation inhibitors prevent varnish and sludge formation and oxidation of metal parts. Typical antioxidants are organic compounds containing nitrogen, such as organic amines, sulfides, hydroxy sulfides, phenols, etc., alone or in combination with metals like zinc, tin, or barium, as well as phenyl-alpha-naphthyl amine, bis(alkylphenyl)amine, N,N diphenyl-p-phenylenediamine, 2,2,4 trimethyldihydroquinoline oligomer, bis(4 isopropylaminophenyl)-ether, N-acyl-p-aminophenol, N-acylphenothiazines, N of ethylenediamine tetraacetic acid, and alkylphenol-formaldehyde-amine polycondensates. Corrosion inhibiting agents or anticorrodants prevent rusting of iron by water, suppress attack by acidic bodies, and form protective film over metal surfaces to diminish corrosion of exposed metallic parts. A typical corrosion inhibiting agent is an alkali metal nitrite, such as sodium nitrite. Other ferrous corrosion inhibitors include metal sulfonate salts, alkyl and aryl succinic acids, and alkyl and aryl succinate esters, amides, and other related derivatives. Borated esters, amines, ethers, and alcohols can also be used with varying success to limit ferrous corrosion. Likewise, substituted amides, imides, amidines, and imidazolines can be used to limit ferrous corrosion. Other ferrous corrosion inhibitors include certain salts of aromatic acids and polyaromatic acids, such as zinc naphthenate. Metal deactivators can also be added to further prevent or diminish copper corrosion and counteract the effects of metal on oxidation by forming catalytically inactive compounds with soluble or insoluble metal ions. Typical metal deactivators include mercaptobenzothiazole, complex organic nitrogen, and amines. Although such metal deactivators can be added to the grease, their presence is not normally required due to the extreme nonreactive, noncorrosive nature of the railroad track/wheel flange grease composition.

The lubricating oils in which the anti-wear additives of this invention are useful and which comprise a major proportion of the lubricating oil compositions may be of synthetic, animal, vegetable, or mineral origin. Ordinarily, mineral lubricating oils are typically used by reason of their availability, general excellence, and low cost. For certain applications, oils belonging to one of the other three groups may be preferred. For instance, synthetic polyester oils such as didodecyl adipate and di-2-ethylhexyl sebacate are often used as jet engine lubricants. Normally, the lubricating oils will be fluid oils, ranging in viscosity from about 40 Saybolt Universal Seconds at 100 degrees F. to about 200 Saybolt Universal Seconds at 210 degrees F. This invention contemplates also the presence of other additives in lubricating compositions. Such additives include, for example, dispersants, viscosity index improving agents, pour point depressing agents, anti-foam agents, extreme pressure agents, rust-inhibiting agents, and oxidation and corrosion inhibiting agents.

The base oil can be naphthenic oil, paraffinic oil, aromatic oil, or a synthetic oil such as a polyalphaolefin polyolester, diester, polyalkyl ethers, polyaryl ethers, silicone polymer fluids, or combinations thereof. The viscosity of the base oil can range from 50 to 10,000 SUS at 100 F.

Other hydrocarbon oils can also be used, such as: (a) oil derived from coal products, (b) alkylene polymers, such as polymers of propylene, butylene, etc., (c) olefin (alkylene) oxide-type polymers, such as olefin (alkylene) oxide polymers prepared by polymerizing alkylene oxide (e.g., propylene oxide polymers, etc., in the presence of water or alcohols, e.g., ethyl alcohol), (d) carboxylic acid esters, such as those which were prepared by esterifying such carboxylic acids as adipic acid, azelaic acid, suberic acid, sebacic acid, alkenyl succinic acid, fumaric acid, maleic acid, etc., with alcohols such as butyl alcohol, hexyl alcohol, 2-ethylhexyl alcohol, etc., (e) liquid esters of acid of phosphorus, (f) alkyl benzenes, (g) polyphenols such as biphenols and terphenols, (h) alkyl biphenol ethers, and (i) polymers of silicon, such as tetraethyl silicate, tetraisopropyl silicate, tetra(4-methyl-2-tetraethyl) silicate, hexyl(4-methol-2-pentoxy) disilicone, poly(methyl) siloxane and poly(methyl)phenylsiloxane.

The preferred base oil comprises about 65% by weight of a refined, solvent-extracted, hydrogenated, dewaxed base oil, preferably 850 SUS oil, and about 35% by weight of another refined solvent-extracted dewaxed base oil, preferably 150 SUS oil, for better results. Type II, II+, and III base are the most preferred currently.

Thickeners useful in the lubricating grease include polyurea, calcium soaps (simple and complex), lithium soaps (simple and complex), and aluminum soaps (simple and complex). Polyurea thickeners are preferred over other types of thickeners because they have high dropping points, typically 460 F. to 500 F., or higher. Polyurea thickeners are also advantageous because they have inherent antioxidant characteristics, work well with other antioxidants, and are compatible with all elastomers and seals. The calcium base material used in the thickener can be calcium oxide, calcium carbonate, calcium bicarbonate, calcium hydroxide, or any other calcium containing substance which, when reacted with a monocarboxylic acid or monocarboxylic acid derivative, provides a calcium carboxylate thickener.

In order to attain extreme pressure properties, antiwear qualities, and/or friction reduction properties, as well as any elastomeric compatibility which may be required, the nanoparticles additives or mixed bases of the overbased phenates and/or sulfonates may comprise a carboxylate, a sulfate, a phosphate and/or a carbonate. Each component, if present, is in an amount of from 0.1 to 15% of the oil or grease composition.

Desirably, the mean particle size of the carboxylate, carbonate, phosphate, and sulfate in the nanoparticles of this invention is generally less than about 100 nanometers. In one embodiment, the mean size is from 1 to 100 nanometers.

With respect to the nanoparticles, the preferred carbonate additive is calcium carbonate. While calcium carbonate is preferred, other carbonate additives can be used, if desired, in conjunction with or in lieu of calcium carbonate, such as the carbonates of Group 2a alkaline earth metal, such as beryllium, magnesium, calcium, strontium, and barium, or the carbonates of a Group 1a alkali metal, such as lithium, sodium, and potassium. Desirably, calcium carbonate is less expensive, less toxic, more readily available, safer, and more stable than other carbonates. Calcium carbonate is also superior to calcium bicarbonate. Calcium carbonate is also water insoluble. Calcium bicarbonate, however, has an acidic proton which at high temperatures can corrosively attack metal surfaces.

With respect to the nanoparticles, while calcium sulfate is the preferred, other sulfate additives can be used, if desired, in conjunction with or in lieu of calcium sulfate, such as the sulfates of Group 2a alkaline earth metal, such as beryllium, magnesium, calcium, strontium, and barium, or the sulfates of a Group a1 alkali metal, such as lithium, sodium, and potassium. Desirably, calcium sulfate is less expensive, less toxic, more readily available, and safer. Calcium sulfate is also superior to calcium bisulfate. Calcium sulfate is also essentially water insoluble and will not wash out of the grease when contamination by water occurs.

With respect to the nanoparticles, the carboxylates used in this invention are of a Group 2a alkaline earth metal, such as beryllium, magnesium, calcium, strontium, and barium, or a Group 1a alkali metal, such as lithium, sodium, and potassium. The carboxylates are of a Group 2a alkaline earth metal or of a Group 1a alkali metal such as those described above. A representative example of such carboxylates includes calcium acetate.

With respect to the nanoparticles, the phosphates used in this invention are of a Group 2a alkaline earth metal, such as beryllium, manganese, calcium, strontium, and barium, or of a Group 1a alkali metal, such as lithium, sodium, potassium, rubidium, cesium, and francium. For example, monocalcium phosphate, dicalcium phosphate, and tricalcium phosphate can be employed in the practice of this invention.

The nanoparticles additive package can further comprise calcium hydroxide. A relatively minor level of calcium hydroxide, when added to the oil or grease, may improve the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the oil or grease.

In any of the above-described forms of the lubricating grease, boron-containing oil separation inhibitors can be optionally added. It was found that borates or boron-containing materials such as borated amine, when used in greases in the presence of calcium phosphates and calcium carbonates, act as an oil separation inhibitor, which is especially useful at high temperatures. Such useful borated additives and inhibitors include: (1) borated amine, such as is sold under the brand name of Lubrizol 5391 by the Lubrizol Corp., and (2) potassium triborate, such as a microdispersion of potassium triborate in mineral oil sold under the brand name of OLOA 9750 by the Oronite Additive Division of Chevron Company. Other useful borates include borates of Group 1a alkali metals, borates of Group 2a alkaline earth metals, stable borates of transition metals (elements), such as zinc, copper, and tin, boric oxide, and combinations of the above. These borated materials may also be used when soap thickeners or mixtures of polyurea and soap thickeners are used. When boron-containing oil separation inhibitors are used in the grease they should be present at 0.01% to 10%, preferably 0.1% to 5%, and most preferably 0.25% to 2.5%, by weight of the boron-containing material in the total grease. Inorganic borate salts, such as potassium triborate, provide an oil separation inhibiting effect similar to borated amines when used in polyurea greases in which calcium phosphate and calcium carbonate are also present. It is believed that the physio-chemical reason for this oil separation inhibiting effect is similar to that for borated amines.

Overbased metal sulfonates are commonly used in lubricating oil compositions as rust inhibitors and detergents. Overbased phenates, including sulfurized phenates, are commonly used in lubricating oil compositions as detergents and antioxidants. Two of the most common classes of metal sulfonates and phenates are overbased magnesium sulfonate and overbased calcium phenate. In general, overbased magnesium sulfonates comprises overbased alkyl benzene sulfonate comprising about 4 to about 100 carbon atoms in the alkyl group, and having a total base number from about 100 to about 500 based on thirty percent soap. In one embodiment, overbased calcium phenates comprises overbased alkyl substituted phenate having about 4 to about 100 carbon atoms in the alkyl group, and having a total base number from about 100 to about 600 based on thirty percent soap.

In general, oil soluble overbased metal sulfonates are made by reacting a metal base with oil-soluble sulfonic acids. Oil-soluble sulfonic acids can be aliphatic or aromatic compounds. Aromatic sulfonic acids are the oil-soluble petroleum sulfonic acids, sometimes referred to as "mahogany acids," aryl sulfonic acids, and alkaryl sulfonic acids. Illustrative of such sulfonic acids are dilauryl benzene sulfonic acid, lauryl cetyl benzene sulfonic acid, paraffin-substituted benzene sulfonic acids, polyolefin alkylated benzene sulfonic acids, such as polybutylene alkylated benzene sulfonic acids in which the polybutylene substituents have molecular weight of at least about 100, and preferably within the range of from about 100 to about 10,000, and polypropylene alkylated benzene sulfonic acids in which the polypropylene substituents have a molecular weight of at least about 80 and preferably within the range of from about 80 to about 10,000. Examples of sulfonic acids are diparaffin wax-substituted phenol sulfonic acids, acetyl chlorobenzene sulfonic acids, cetyl-phenol disulfide sulfonic acids, cetyl-phenol monosulfide sulfonic acids, and cetoxy capryl benzene sulfonic acids. Oil-soluble sulfonic acids are well described in the art, such as for example U.S. Pat. No. 2,616,604; U.S. Pat. No. 2,626,207; and U.S. Pat. No. 2,767,209, and others.

Some metal salts of the above compounds have the formula $[SO_3\text{-}A\text{-}R]nM_1$ where A is a substituted benzene ring; R is alkyl or hydroxy, chloro or bromo hydrocarbyl; $M_1$ is magnesium, calcium, barium, or mixtures thereof; and n is 2. In some cases the R group can be made by polymerizing $C_2$-$C_6$ olefins to a molecular weight in the range of about 80 to about 10,000, preferably about 80 to about 1,000, and then attaching said group to a benzene ring by well known alkylation techniques. R can be a variety of hydrocarbon moieties or substituted hydrocarbon which results in an oil soluble benzene sulfonic acid or salt thereof. For example, R can be a low molecular weight alkyl such as iso-butyl, nonyl, dodecyl, and the like; an intermediate molecular weight hydrocarbyl such as $C_{15}$-$C_{100}$ polybutene or polypropylene polymers; a higher molecular weight hydrocarbyl such as polyolefin having a number average molecular weight of 10,000, and others. R can be substituted with groups such as chlorine, bromine, hydroxy, nitro, or sulfonic acid groups. Also, the benzene ring of the sulfonic acid may have more than one substituent alkyl, or hydroxy, halo, nitro or sulfonic acid alkyl groups.

Non-aromatic sulfonic acids are generally made by the sulfonation of most any aliphatic hydrocarbon such as alkanes, alkenes, and the like. Also, the hydrocarbyl may contain various substitutions which do not interfere with later reactions or end use. One group of non-aromatic sulfonic acids is made by the sulfonation of polymers or copolymers, such as polymerized or copolymerized olefins. The term polymer olefins as used herein refers to amorphous polymers and copolymers derived from olefinically unsaturated monomers. Such olefin monomers include olefins of the general formula $RCH{=}CH_2$, in which R comprises aliphatic or cycloaliphatic radical of from 1 to about 20 carbon atoms, for example, propene, isobutylene, butene-1,4-methyl-1-pentene, decene-1, vinylidene norbornene, 5-methylene-2-norbornene, etc. Other olefin monomers having a plurality of double bonds may be used, in particular diolefins containing from about 4 to about 25 carbon atoms, e.g., 1,4-butadiene, 2,3-hexadiene, 1,4-pentadiene, 2-methyl-2,5-hexadiene, 1,7-octadiene, etc. These polyolefins have number average molecular weights from about 36 to about 10,000 or higher, but preferably from about 80 to about 10,000. Representative examples of these materials include polypropylene or polybutylene polymers. The olefin may be a copolymer, such as an ethylene propylene copolymer or ethylene-propylene-hexadiene terpolymer, or others.

The preparation of the sulfonic acids is well known. For example, sulfonic acids can be prepared by reacting the material to be sulfonated with a sulfonating agent, such as concentrated sulfuric acid, fuming sulfuric acid, chlorosulfonic acid or sulfur trioxide for a period of time sufficient to effect sulfonation, and thereafter separating insoluble acid sludge from the oil-soluble sulfonic acid. Overbased sulfonates are commonly made by the reaction of sulfonic acid with metal bases such as the oxide, hydroxide, or carbonate of calcium, magnesium or barium. In some cases the sulfonate can be made from the metal itself or a derivative of said metal. Representative processes for making overbased sulfonates are described in U.S. Pat. Nos. 3,126,340; 3,492,230; 3,524,814 and 3,609,076, incorporated herein by reference. The carbonate overbased magnesium sulfonates are preferably made from magnesium oxide and carbon dioxide in the presence of a promoter such as ethylene diamine or ammonia. However, some overbased sulfonates contain no carbonate.

Phenates are generally the reaction product of phenol or substituted phenol with a metal base. In some cases, phenates also contain sulfur.

Substituted phenols are generally mono-, di-, or tri-hydrocarbyl substituted, such as alkyl, alkenyl, aryl, aralkyl or alkaryl. Typically the phenols are monoalkyl substituted. The hydrocarbyl can comprise low molecular weight groups such as methyl, ethyl, the isomers of propyl, butyl, pentyl, hexyl, heptyl, octyl, nonyl, decyl, and the like, up to high molecular weight materials having a number average molecular weight of 10,000 or more. These hydrocarbyl substituents can be polymer olefins previously described. Representative hydrocarbyl substituents have a molecular weight of about 80 to about 10,000, in one embodiment from about 80 to about 200. Many commercially available substituted phenols contain about $C_4$ to about $C_{100}$, in one embodiment $C_8$ to $C_{20}$ substituents from polypropylene or polybutene. The hydrocarbon substituted phenol may have other substituents, such as for example, chlorine, bromine, nitro or sulfonic acid groups so long as such substitution does not interfere with the various reactions nor adversely affect the utility of the composition.

The base used to overbase the phenate and/or sulfonate is typically a metal oxide, hydroxide, or a carbonate. Common metals are calcium, barium, strontium, and magnesium. Typically the base is calcium oxide, calcium carbonate, or calcium hydroxide. Some metal phenates can be represented by the following hypothetical structure: $M_2[O\text{-}A\text{-}Ra]_2$ where A is a substituted benzene group; $M_2$ is a Group II metal; R is a hydrocarbyl group and a is independently in each occurrence 1, 2, 3, or 4. However, because the metal phenate is overbased, this structure may be inaccurate in that an excess of metal base is commonly associated with the above structure.

Some sulfur containing phenates can be represented by the following hypothetical structure: $M_2[\text{-}O\text{-}AR_a\text{—}S_x\text{-}AR_a\text{—}O\text{—}]$ where A is a substituted benzene group; $M_2$ is a Group II metal, R is a hydrocarbyl group, a is independently in each occurrence 1, 2, 3, or 4; and x is 1, 2, 3, or 4. In this structure, alternatively, three or more phenol residues can be connected by $\text{—}S_x$-bridges. However, because the sulfur containing metal phenate is overbased, this structure may be inaccurate in that an excess of metal base is commonly associated with the above structures.

Oftentimes, phenates contain sulfur, such as a sulfur bridge between two phenyl groups containing one, two, three, four, or more sulfur atoms. In some cases, several phenols or substituted phenols are bridged together by a number of sulfur bridges. The sulfur can be introduced by the reaction of elemental sulfur or $SCl_2$ with phenol or substituted phenol, or by the reaction of elemental sulfur or $SCl_2$ with metal phenate.

Methods of making various phenates and sulfur containing phenates and overbasing can be found in U.S. Pat. Nos. 3,966,621; 3,969,235; 3,953,519; 3,932,289; 3,923,670; 3,801,507; 3,036,971; 3,810,837; 3,761,414; 3,336,224; 3,178,368; 3,437,595; and 3,464,970, incorporated herein by reference.

The mixed base sulfonate and/or phenate anti-wear compositions of this invention are generally manufactured by reacting at reaction conditions overbased metal sulfonate, phenate, or mixtures thereof, with acidic compound comprising sulfuric acid, organic carboxylic acid, organic carboxylic acid anhydride, phosphoric acid, phosphoric acid ester, thiophosphoric acid ester, or mixtures thereof. Commonly, the reaction is conducted at ambient temperatures, such as above 32 degrees F. (0 degree C., in one embodiment from about 75 degrees F. (24 degrees C.) to about 250 degrees F. (121 degrees C.), in another embodiment from about 100 degrees F. (38 degrees C.) to about 200 degree F. (93 degrees C.). Ambient pressures are typically employed, typically about one atmosphere. In some cases, it is helpful to use water or methanol in order to promote the reaction of acidic compound with basic compound. The desirability of using such a promoter can be determined by routine testing. Often the reaction is conducted in a solvent, such as a light hydrocarbon or lubricating oil. Sequential addition of one or more acids can also be employed.

The acids used to form the mixed base phenates and/or sulfonates of this invention include those capable of reacting with sulfonate, phenate, or mixtures thereof overbased with carbonate, thereby improving the properties of said overbased material. The acidic compound reacts with the carbonate to form a metal sulfate, metal phosphate, or metal carboxylate. Depending on the amount of acid or acids used, the metal base initially present in the starting overbased material may be present in the final product or essentially fully reacted. The resulting composition possesses or compositions possess improved anti-wear properties. Because not all organic carboxylic acids or anhydrides, phosphoric acid or acid esters, sulfuric acid, or mixtures thereof improve the various above mentioned properties, they must be tested and determined empirically. Another method of forming the mixed base phenates and/or sulfonates is by initially mixing the phenate and/or sulfonate during the overbasing process to form a mixed base composition. For example, sodium carbonate and sodium sulfate may be added to a phenate to form an overbased composition.

In some cases the compositions can be made by reacting acidic compound with overbased phenates and/or sulfonates. For example, in the manufacture of overbased metal sulfonates and phenates, acidic compound can be added to the reaction mixture after the overbased metal sulfonate or phenate is substantially formed. This is conveniently done by contacting the overbased material in a solvent with the acidic compound at a temperature from about 75 degrees F. to about 250 degrees F. for a time sufficient to incorporate at least a portion of the acid. Preferably, a substantial portion of the acid is incorporated. In some cases, it may be possible to conduct the reaction at higher or lower temperatures. Higher temperatures generally lead to faster reaction time but can also lead to some decomposition. Reaction conditions are generally selected to maintain sufficiently fast reaction periods while maintaining product quality by minimizing decomposition. The acidic compound can be added in one batch or added incrementally, in a controlled manner, to the overbased phenate and/or sulfonate.

The reaction can be carried out at atmospheric pressure, although either pressure or vacuum systems may be used. In some cases it is desirable to blanket the reaction mixture with an inert gas, such as nitrogen, in order to minimize oxidation, degradation, and unwanted side reactions. The reactants should be mixed so that the basic material and acidic material can be readily contacted. The reaction can be carried out on a batch basis where the reactants are introduced into a reaction zone such as a stirred reactor, the reaction carried out and the product removed; or on a continuous basis where controlled proportions of reactants are continuously contacted together at one end of a reaction zone, and product removed from another end of the reaction zone.

The compositions can be formed over wide ranges of overbased compound to acidic compound. When a metal carbonate and a metal sulfate are desired and a metal carbonate is initially present as the base of the overbased phenate and/or sulfonate, then sufficient sulfuric acid is reacted with the carbonate so that the weight ratio of sulfate to carbonate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid is reacted with the carbonate prior to overbasing of the phenate and/or sulfonate. In another alternative, metal sulfate is simply added to the overbased phenate and/or sulfonate to bring the ratio to the desired ratio. Likewise, combinations of these techniques can be used to make the anti-wear additive of this invention. Alternatively, if a hydroxide or oxide is present as the base of the overbased phenate and/or sulfonate, then carbon dioxide can be, e.g., bubbled through the composition which reacts to form carbonate and sulfuric acid can be added which also reacts with the hydroxide or oxide to form sulfate.

If a hydroxide or oxide is present in the overbased phenate and/or sulfonate, and if a mixed base is desired with other than carbonate, then the sulfuric acid, phosphoric acid, and/or carboxylic acid or anhydride, and combinations thereof, can be reacted with the overbased phenate and/or sulfonate to form the final mixed base phenate and/or sulfonate, containing a combination of sulfate, phosphate, and carboxylate. Alternatively, carbon dioxide can be bubbled through the overbased phenate and/or sulfonate containing the hydroxide or oxide to thereby convert the hydroxide or oxide base present into carbonate.

When a metal sulfate and a metal phosphate overbasing are desired and a metal carbonate is initially present as the base of the overbased phenate and/or sulfonate, then sufficient sulfuric acid and phosphoric acid are reacted (either sequentially or contemporaneously) with the carbonate so that the weight ratio of sulfate to phosphate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid and phosphoric acid are reacted with the carbonate prior to overbasing of the phenate and/or sulfonate. In another alternative, metal sulfate or metal phosphate is simply added to the overbased phenate and/or sulfonate to bring the ratio to the desired ratio, and then the balance of the carbonate is reacted with either sulfuric acid or phosphoric acid, as appropriate. In still another alternative, if the overbased phenate and/or sulfonate contains hydroxide or oxide as the base, then sulfuric acid and phosphoric acid can be reacted in the desired proportions to form the final mixed base phenate and/or sulfonate anti-wear additive. Likewise, combinations of these techniques can be used to make the anti-wear additive of this invention.

When a metal sulfate and a metal carboxylate overbasing are desired and a metal carbonate is initially present as the base of the overbased phenate and/or sulfonate, then sufficient sulfuric acid and carboxylic acid or anhydride are reacted (either sequentially or contemporaneously) with the carbonate so that the weight ratio of sulfate to carboxylate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the sulfuric acid and carboxylic acid or anhydride are reacted with the carbonate prior to overbasing of the phenate and/or sulfonate. In another alternative, metal sulfate or metal carboxylate is simply added to the overbased phenate and/or sulfonate to bring the ratio to the desired ratio, and then the balance of the carbonate is reacted with either sulfuric acid or carboxylic acid or anhydride, as appropriate. Likewise, combinations of these techniques can be used to make the anti-wear additive of this invention.

When a metal carboxylate and a metal phosphate overbasing are desired and a metal carbonate is initially present as the base of the overbased phenate and/or sulfonate, then sufficient carboxylic acid or anhydride and phosphoric acid are reacted (either sequentially or contemporaneously) with the carbonate so that the weight ratio of carboxylate to phosphate in the final product is from about 1:10 to about 10:1, in one embodiment from about 1:4 to about 4:1, in another embodiment from about 1:3 to about 3:1, in another embodiment from about 1:2 to about 2:1, and in one particular embodiment about 1:1. Alternatively, the carboxylic acid or anhydride and phosphoric acid are reacted with the carbonate prior to overbasing of the phenate and/or sulfonate. In another alternative, metal carboxylate or metal phosphate is simply added to the overbased phenate and/or sulfonate to bring the ratio to the desired ratio, and then the balance of the carbonate is reacted with either carboxylic acid or anhydride, or phosphoric acid, as appropriate. Likewise, combinations of these techniques can be used to make the anti-wear additive of this invention.

When combinations of three or four of the metal carbonate, metal sulfate, metal phosphate, and metal carboxylate overbasing are desired and a metal carbonate is initially present as the base of the overbased phenate and/or sulfonate, then sufficient sulfuric acid, phosphoric acid, and/or carboxylate acid or anhydride (as well as carbon dioxide if the starting overbased phenate and/or sulfonate contains hydroxide or oxide) are reacted with the carbonate to form the desired ratio of the three or four components. In the three and four component systems, the amount of each base present can vary widely. If present, the weight ratio of sulfate in the mixed base phenate and/or sulfonate to the total amount of other base present can be from about 1:1000 to about 1000:1. If present, the weight ratio of phosphate in the mixed base phenate and/or sulfonate to the total amount of other base present can be from about 1:1000 to about 1000:1. If present, the weight ratio of carbonate in the mixed base phenate and/or sulfonate to the total amount of other base present can be from about 1:1000 to about 1000:1. If present, the weight ratio of carboxylate in the mixed base phenate and/or sulfonate to the total amount of other base present can be from about 1:1000 to about 1000:1.

As an alternative to the procedure discussed above, the mixed base phenate and/or sulfonate can be made in essentially two or more batches by converting all of the hydroxide, oxide or carbonate to a desired overbased material (e.g., all sulfate). Next, all of the hydroxide, oxide or carbonate can be converted to a desired base material (e.g. phosphate) in a second batch. The resulting batches can then be blended together to form the final mixed base phenate and/or sulfonate, with a desired weight ratio of first base to second base. Likewise, this procedure can be used to form three-component and four-component mixed base phenates and/or sulfonates.

The mixed base phenate and/or sulfonate anti-wear additive composition of this invention is generally added to lubricating oil and grease in order to improve various properties of said oil or grease. Depending on the nature of the oil or grease, the intended use and the desired improvement, different amounts of the additive may be needed in order to be effective. The anti-wear additive is generally present in a lubricating oil or grease at a concentration of about 0.01 to about 50 weight percent, preferably about 0.05 to about 20 weight percent, still more preferably about 0.5 to about 5 weight percent.

In most cases, overbased metal sulfonates or phenates are dissolved or suspended in a solvent or oil so that they can be easily transported and dissolved or suspended as additives in lubricating oil. Therefore, such materials are commonly purchased or manufactured with lubricating oil present. Additional oil may be added if desired for the reaction of basic compound with acidic compound in order to reduce viscosity, improve filterability and processability, and the like. It is generally desirable to use diluent lubricating oil of such a quality so that it can remain unseparated in the product and not adversely affect end use. Other diluents such as naphtha, light hydrocarbons, especially $C_5$-$C_8$ hydrocarbons, are more effective at reducing viscosity but most often must be removed from the final product.

The organic carboxylic acids or acid anhydrides of this invention can vary in molecular weight from extremely low on up to extremely high molecular weight compounds. Generally, the viscosity of such compounds increases with molecular weight and less moles are contained in a given weight. Therefore, it is generally desirable to use acids and anhydrides containing less than 1,000 carbon atoms to aid manufacture of the final product and to prevent the acidic compound from contributing too greatly in weight to the final product.

The organic carboxylic acids can be straight chain or branched, saturated, unsaturated or aromatic. Often an acid will fall within more than one of these categories. The acids may contain substituents such as chlorine, bromine, hydroxy, nitro, oxygen such as ketone, and other groups so long as such substitution is not detrimental to the final product.

Some carboxylic acids are saturated acids such as formic, acetic, propionic, butyric, valeric, caproic, caprylic, capric, lauric, myristic, palmitic, stearic, and branched isomers thereof; unsaturated acids such as oleic, linoleic, linolenic, acrylic, methacrylic, undecylinic; aromatic acids such as benzoic, toluic, chlorobenzoic, bromobenzoic, nitrobenzoic, phthalic, isophthalic, terephthalic, salicylic, hydroxybenzoic, anthranilic, aminobenzoic, methoxybenzoic, hemimellitic, trimellitic, trimesic; dicarboxylic acids such as oxalic, malonic, succinic, glutaric, adipic, pimelic, suberic, azelaic, sebacic, maleic, fumaric, dimerized acids of same or different acids which can be made by the condensation of unsaturated carboxylic acids. Anhydrides of the various dicarboxylic acids, especially vicinal dicarboxylic acids, are representative acidic compounds for the practice of this invention.

One particular group of carboxylic acids or anhydrides thereof are alkyl or alkenyl substituted dicarboxylic acids or anhydrides thereof. One such acid is alkenyl substituted succinic acid or anhydride. These substituted acids or anhydrides commonly have from about 8 to about 1,000 carbon atoms, preferably about 10 to about 56 carbon atoms, in the alkenyl group. Substituted succinic anhydride is often made by the reaction of maleic anhydride with olefinic materials. Some olefinic materials are low molecular weight alpha-olefins or polymeric olefins. Of these polymers, one group is the polypropylene or butylene polymers. A number of the substituted succinic acids and anhydrides are commercially available.

Thiophosphoric acid esters are commonly the reaction products of $P_2S_5$ with alcohols. The reaction of $P_2S_5$ with alcohols is well known from the manufacture of zinc dialkyl or diaryl dithiophosphate. See for example U.S. Pat. No. 4,113,634 which describes the reaction of about 4 moles of hydroxy compound with one mole of phosphorus pentasulfide at a temperature from about 100 degrees F. (38 degrees C.) to about 250 degrees F. (121 degrees C.)

Esters of $H_3PO_4$ are also commonly made by reacting alcohols with $H_3PO_4$ at well known conditions. Most commonly, these esters comprise mono- or di-esters of $C_1$ to about $C_{20}$ alcohols. A wide range of alcohols can be used for the various esterification reactions, with many having from about one to about twenty carbon atoms. Preferably, the alcohol contains about one to about ten carbon atoms. The alcohol provides a hydrocarbyl group to the phosphoric or thio phosphoric acid ester which enhances its oil solubility and the oil solubility of the final reaction product of basic compound with acidic compound. The hydrocarbyl can be saturated, unsaturated, branched, straight chain, or aromatic and also have various substitutions such as chlorine, bromine, amino, nitro, acid groups and the like so long as such substitution is not detrimental to reaction of basic compound with acidic compound and is not detrimental to the final product. Some alcohols are methyl, ethyl, propyl, butyl, pentyl, heptyl, octyl, decyl, dodecyl or branched chain alcohols such as methyl or ethyl branched isomers of the above. Primary and secondary alcohols are typically employed. Representative branched alcohols are isopropyl, 2-methyl-1-1-pentanol, 2-ethyl-1-hexanol, 2,2-dimethyl-1-octanol, and alcohols prepared from olefin oligomers such as propylene dimer or trimer by hydroboration-oxidation or by the Oxo process. One might use mixtures of alcohols because of their low cost and possible improvements in performance. One particular compound made from alcohols comprises O,O'-dibutyl phosphoric acid.

Some representative aromatic alcohols are phenol and substituted phenol comprising about 6 to about 20 carbon atoms. Common substituted phenols contain hydrocarbyl groups such as alkyl, alkenyl, aryl, aralkyl or alkaryl. Mono alkyl substitution is typically employed. The hydrocarbon substitution can range from low molecular weight groups such as methyl, ethyl, propyl, isopropyl, butyl, isobutyl, and the like up to low molecular weight polymers and copolymers. Many commercially available substituted phenols contain $C_8$-$C_{12}$ substituents from polypropylene or polybutene. The hydrocarbyl substituted phenol may have other substituents, such as for example, chlorine, bromine, nitro, amine, acid groups and the like.

The sulfates used in the mixed base overbased phenate and/or sulfonate anti-wear additives of this invention are of Group 2a alkaline earth metal, such as beryllium, magnesium, calcium, strontium, and barium, or the sulfates of a Group a1 alkali metal, such as lithium, sodium, and potassium.

The carboxylates used in the anti-wear additives mixed base overbased phenate and/or sulfonate of this invention are of Group 2a alkaline earth metal, such as beryllium, magnesium, calcium, strontium, and barium, or a Group 1a alkali metal, such as lithium, sodium, and potassium. The carboxylates are of a Group 2a alkaline earth metal or of a Group 1a alkali metal such as those described above. A representative example of such carboxylates includes calcium acetate.

The phosphates used in the mixed base overbased phenate and/or sulfonate anti-wear additives of this invention are of a Group 2a alkaline earth metal, such as beryllium, manganese, calcium, strontium, and barium, or of a Group 1a alkali metal, such as lithium, sodium, potassium, rubidium, cesium, and francium. For example, monocalcium phosphate, dicalcium phosphate, and tricalcium phosphate can be employed in the practice of this invention.

The mixed base phenate and/or sulfonate additives can further comprise calcium hydroxide. A relatively minor level of calcium hydroxide, when added to the oil or grease, may improve the wear resistance properties. Also, the calcium hydroxide provides additional excess alkaline reserve which can be useful to help neutralize any acidic products which may result from high temperature oxidation of the grease over long periods of time. Preferably, the calcium hydroxide, when present, should be present at 0.01% to 5% by weight of the grease.

Other solid additives in particle form, including nanoparticles, may be used in this invention in addition to the carbonates, carboxylates, phosphates and sulfates. Such other solid additives include but are not limited graphite, molybdenum disulfide, and TEFLON polymers.

Although illustrative embodiments and methods have been shown and described, a wide range of modifications, changes, and substitutions is contemplated in the foregoing disclosure and in some instances some features of the embodiments or steps of the method may be employed without a corresponding use of other features or steps. Accordingly, it is appropriate that the claims be construed broadly and in a manner consistent with the scope of the embodiments disclosed herein.

What is claimed is:

1. A lubricant oil composition, comprising:

a base oil present in said composition;

an additive package comprising solid additives in the form of nanoparticles, the nanoparticles having a mean diameter in the range from 1 to 100 nanometers and present in an amount of 0.1% to 10% based on the total weight of the composition, wherein the nanoparticles comprise (a) a carbonate of a Group 2a alkaline earth metal, (b) a sulfate of a Group 2a alkaline earth metal, (c) a phosphate of a Group 2a alkaline earth metal, and (d) a carboxylate of a Group 2a alkaline earth metal, wherein the weight ratio of sulfate to carbonate is from about 1:1, the weight ratio of sulfate to phosphate is about 1:1, the weight ratio of sulfate to carboxylate is about 1:1 and the weight ratio of carboxylate to phosphate is about 1:1; and the nanoparticles further comprising an overbased metal phenate, an overbased metal sulfonate, or both and wherein said additive package is present in said base oil in an amount of 0.1% to 1.0% by weight;

wherein the nanoparticles are permanently suspended in the lubricant oil composition;

wherein the lubricant oil composition has a viscosity of about 40 Saybolt Universal Seconds at 100 degrees F.;

wherein the lubricant oil composition is formulated as an engine oil for a gasoline internal combustion engine of an automobile; and wherein the sulfate, the phosphate and the carboxylate are reaction products of the carbonate.

2. A method of manufacturing a lubricant oil composition, comprising:

combining and mixing a base oil present in said composition and an additive package comprising solid additives in the form of nanoparticles, the nanoparticles having a mean diameter in the range from 1 to 100 nanometers and present in an amount of 0.1% to 10% based on the total weight of the composition, wherein the nanoparticles comprise (a) a carbonate of a Group 2a alkaline earth metal, (b) a sulfate of Group 2a alkaline earth metal, (c) a phosphate of a Group 2a alkaline earth metal, and (d) a carboxylate of a Group 2a alkaline earth metal, wherein the weight ratio of sulfate to carbonate is from about 1:1, the weight ratio of sulfate to phosphate is about 1:1, the weight ratio of sulfate to carboxylate is about 1:1 and the weight ratio of carboxylate to phosphate is about 1:1; and the nanoparticles further comprising an overbased metal phenate, an overbased metal sulfonate, or both and wherein said additive package is present in said base oil in an amount of 0.1% to 1.0% by weight;

wherein the nanoparticles are permanently suspended in the lubricant oil composition; wherein the lubricant oil composition has a viscosity of about 40 Saybolt Universal Seconds at 100 degrees F.;

wherein the lubricant oil composition is formulated as an engine oil for a gasoline internal combustion engine of an automobile; and wherein the sulfate, the phosphate and the carboxylate are reaction products of the carbonate.

3. A method of lubricating a substrate, comprising applying the oil composition of claim 1 to the substrate.

4. The lubricant oil composition of claim 1 wherein said oil comprises 65% by weight of refined solvent-extracted hydrogenated, dewaxed base oil.

5. The lubricant oil composition of claim 1 wherein said oil comprises 65% by weight of refined solvent-extracted hydrogenated, dewaxed base oil and 35% by weight of another refined solvent extracted, dewaxed base oil.

* * * * *